US006705242B2

(12) United States Patent
Donovan

(10) Patent No.: US 6,705,242 B2
(45) Date of Patent: Mar. 16, 2004

(54) METHOD AND APPARATUS FOR HERMETICALLY SEALING OPENINGS OF AN EXPLOSION CONTAINMENT CHAMBER

(75) Inventor: John Donovan, Danvers, IL (US)

(73) Assignee: CH2M Hill Constructors, Inc., Englewood, CO (US)

( * ) Notice: Subject to any disclaimer, the term of this patent is extended or adjusted under 35 U.S.C. 154(b) by 78 days.

(21) Appl. No.: 09/683,495

(22) Filed: Jan. 8, 2002

(65) Prior Publication Data

US 2003/0159629 A1 Aug. 28, 2003

(51) Int. Cl.[7] ..... F23M 7/00; F23M 5/00

(52) U.S. Cl. ..... 110/341; 110/173 R; 110/181; 588/1

(58) Field of Search ..... 588/1; 405/9, 192; 454/195, 370; 49/68; 114/335; 110/173 C, 341, 173 B, 242, 173 R, 180, 181

(56) References Cited

U.S. PATENT DOCUMENTS 2,807,056 A * 9/1957 Vogt ..... 20/4
2,977,106 A * 3/1961 Duff ..... 263/50
3,032,835 A * 5/1962 Saar et al. ..... 20/16
3,150,618 A * 9/1964 Rosenfeld ..... 109/1
3,678,624 A * 7/1972 Bicicchi ..... 49/68
3,711,993 A * 1/1973 Liesch et al. ..... 49/68
3,766,844 A * 10/1973 Donnelly et al. ..... 98/33 R
4,111,753 A * 9/1978 Folsom et al. ..... 195/126
5,233,932 A * 8/1993 Robertson ..... 110/232
5,263,425 A * 11/1993 Koenig ..... 110/173 C
5,711,706 A * 1/1998 Griffin et al. ..... 454/338
5,884,569 A 3/1999 Donovan
RE36,912 E 10/2000 Donovan
6,173,662 B1 1/2001 Donovan

* cited by examiner

*Primary Examiner*—Ira S. Lazarus
*Assistant Examiner*—K. B. Rinehart
(74) *Attorney, Agent, or Firm*—Faegre & Benson LLP

(57) ABSTRACT

A method and apparatus to hermetically seal openings in an explosion suppression chamber. The present invention utilizes an air lock device to ensure that, in the event toxins are released from the primary explosion chamber opening closing means, the toxins are properly handled and are not inadvertently released into the atmosphere. The preferred embodiment of the present invention uses negative pressure to vacuum the entrained air within the airlock cavity subsequent to an explosion. An alternate embodiment of the present invention uses positive pressure within the air lock cavity to force air through integral filter membranes.

24 Claims, 1 Drawing Sheet

METHOD AND APPARATUS FOR HERMETICALLY SEALING OPENINGS OF AN EXPLOSION CONTAINMENT CHAMBER

CROSS REFERENCE TO RELATED APPLICATIONS

This application is related to my application Ser. No. 09/457,976, filed Dec. 9, 1999, now issued U.S. Pat. No. 6,354,181 which is a continuation-in-part of my application Ser. No. 09/191,045, filed on Nov. 12, 1998, now issued U.S. Pat. No. 6,173,662. Patent application Ser. No. 09/191,045 is also a continuation-in-part of my application Ser. No. 08/823,223 filed Mar. 24, 1997, now issued U.S. Pat. No. 5,884,569. The latter application is a continuation-in-part of my parent application Ser. No. 08/578,200, filed Dec. 29, 1995, now issued U.S. Pat. No. 5,613,453 which has since been reissued with Re. 36,912 on Oct. 17, 2000. This patent application is commonly assigned as the patents and applications stated above and incorporates herein all of the same by reference.

BACKGROUND OF INVENTION

The present invention relates generally to a method and apparatus for containing, controlling and suppressing the detonation and destruction of explosives and resultant toxic materials released, specifically biological and chemical weapons. More particularly, the present invention relates to the ability to hermetically seal opening locations within an explosion suppression and containment chamber to further ensure that there is no environmental contamination or leaks from the main method of sealing the openings.

The present invention relates to, and is intended to be used in conjunction with, my explosion suppression and containment device disclosed in my U.S. Letters Pat. Nos. 6,173,662, 5,884,569, and Re. 36,912. However, it should be understood that although focusing on my disclosed explosion suppression and containment device, the present invention can effectively be utilized on other types of explosion containment and suppression devices, as well as any other devices which may benefit from the present invention.

Currently, explosion containment and suppression chambers are utilized for many purposes, ranging from hardening of steel and metals to the destruction of weaponry. Some common types of weaponry which are intended to be destroyed within such an explosion chamber include, but are not limited to, munitions, mortars, biological, chemical and other toxin-releasing agents.

This type of weaponry is generally destroyed by detonating the weapon with a predetermined amount of explosive material. For example, to destroy a chemical agent weapon, the weapon is generally encased with an explosive material, placed inside of the explosion suppression and containment chamber, wherein the explosive material is detonated and the weapon is essentially vaporized. Due to the extreme and instantaneous temperature and pressure increase, substantially all of the toxic material contained within the weapon is vaporized.

The main purpose of the explosion suppression and containment chamber is to contain and ultimately suppress the explosive forces inherent with the destruction of such weaponry. Furthermore, the explosion chamber, as disclosed in my above mentioned patents, is intended to provide an air-tight explosion atmosphere wherein whatever toxic material remains after weapons destruction is contained in an enclosed environment wherein it can be properly handled and disposed of. My U.S. Pat. Nos. 6,173,662, 5,884,569, and Re. 36,912 disclose a system which has exhaust orifices located along the perimeter of the explosion chamber to collect contained toxic gases and contaminants. These exhaust orifices are subsequently connected to manifolds, which run along the length of the explosion chamber. The manifolds are then connected to an air handling and cleaning device, such as an air scrubber. As such, once an explosion within the chamber commences, there is an exhaust fan which pulls the toxic laden air, due to the vaporization of the weapon and any contained chemical or biological agents, through the exhaust orifices, into the manifolds system and finally to the air handling and cleaning device. Once the air has been properly cleaned and stripped of toxic materials, it can then be released into the atmosphere.

As can be expected, there are many extremely dangerous and toxic materials which can be destroyed within the explosion containment and suppression chamber. It is thus imperative that these dangerous toxins are properly contained and not allowed to enter the atmosphere throughout the entire destruction process, whereas subsequent toxin release can be extremely deadly to the human population. As stated previously, the initial destruction of the weapon by explosion vaporizes substantially all of the toxic material. However, there are inevitably some traces of toxins in the air within the explosion suppression and containment chamber.

As such, and as disclosed in my U.S. Pat. Nos. 6,173,662, 5,884,569, and Re. 36,912, an airtight explosion chamber is utilized to destroy such weapons. To enhance the chamber's airtight design, I disclosed utilization of an access door which opens inwardly into the explosion chamber. Thus when the explosion occurs, the explosion itself has the effect of providing a tighter seal around the periphery of the door due to the explosion's outward forces, subsequently sealing the door even further. However, a limitation of such a design is that this type of interior access, although extremely reliable and effective, is the only method utilized to ensure that no toxic gases and materials inadvertently escape the explosion chamber and thus enter the atmosphere, potentially causing great harm. If, for example, there is an undetected leak due to an irregularity inherent within the doorframe and the primary sealing mechanism, dangerous toxins can inadvertently be released into the atmosphere. The present invention overcomes this limitation by, for example, providing a vacuum airlock assembly which acts as a secondary means to ensure there are no toxic leaks.

The present invention overcomes the disadvantages and/or shortcomings of known prior explosion suppression and containment chamber protection system opening sealing means and provides significant improvements thereover.

SUMMARY OF INVENTION

It is an object of the present invention to provide an improved toxic gas and contamination containment apparatus for an explosion containment and suppression chamber.

It is another object of the present invention to provide an improved gas and contamination containment method for an explosion containment and suppression chamber.

It is yet another object of the present invention to provide either a primary or secondary means of hermetically sealing openings within an explosion containment and suppression chamber.

It is yet another object of the present invention to provide an airlock assembly wherein contained air is transported to an air handling and cleansing device prior to environmental release.

It is still another object of the present invention to provide an apparatus and method to enhance personnel safety while operating an explosion containment and suppression chamber.

The present invention is intended to be used in conjunction with my explosion suppression and containment device disclosed in my U.S. Pat. Nos. 6,173,662, 5,884,569, and Re. 36,912. However, it should be understood that although focusing on my disclosed explosion suppression and containment device, the present invention can effectively be utilized on other types of explosion containment and suppression devices, as well as any other device which may benefit from the present invention.

The present invention utilizes a conventional self-sealing door, preferably with a resilient sealing member around the periphery of the door surface, to ensure an airtight intersection against the sealing seat of the explosion chamber. The self-sealing door is preferably hinged in an inwardly closing manner. When the door is closed, an airlock cavity is thus provided between the primary door of the explosion suppression chamber and the present invention.

The present invention further incorporates a vacuum tube connection. The proximate end of the vacuum tube is connected to an orifice located approximately in the center of the airlock door and is connected to the explosion chamber's air handling device at its distal end. As such, subsequent to detonating an explosion, the air-handling device is started and the vacuum tube evacuates the air within the airlock, including any inadvertently released toxins from the primary door sealing means. Once the air handling device is complete and the vacuum assembly is shutdown, the airlock assembly of the present invention can be opened, being ensured that there are no toxins present and inadvertently released into the atmosphere.

BRIEF DESCRIPTION OF DRAWINGS

The preferred embodiment is herein described in detail with references to the drawings, where appropriate, wherein.

DETAILED DESCRIPTION

The preferred embodiment of the present invention is best described as a negative pressure airlock access door to an explosion containment and suppression chamber.

The present invention is intended to be utilized with an explosion suppression chamber as disclosed in my U.S. Pat. Nos. 6,173,662, 5,884,569, and Re. 36,912. It is to be understood, of course, that the present invention can be utilized with differing configurations and on different types and designs of explosion suppression chambers, or other devices which require such an airlock design, while still achieving its objectives and goals. By providing a self-contained cavity between the explosion suppression chamber primary door and the environment, the present invention has the ability to controllably ensure that there are no toxins released into the environment.

Figure 1:
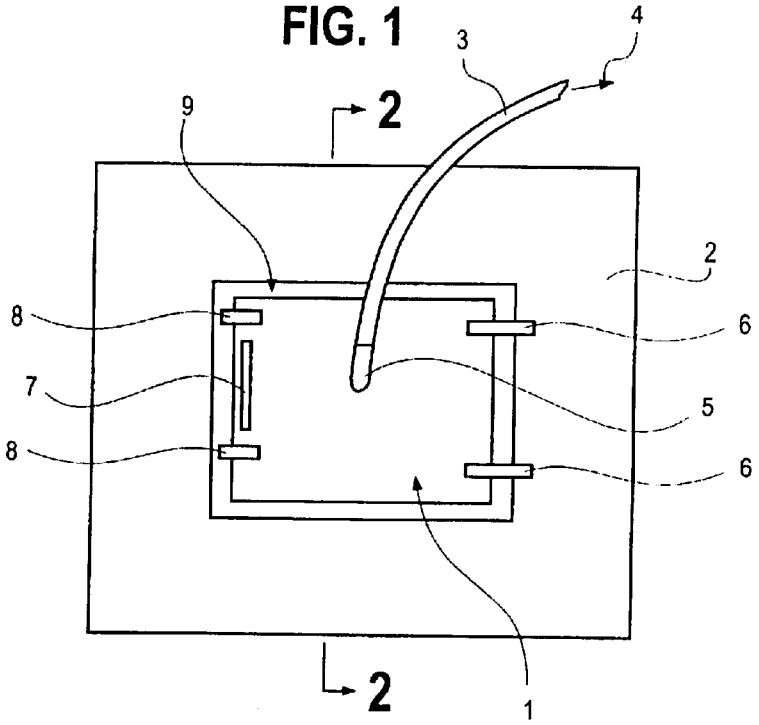
FIG. 1 is an elevation view of the present invention in a closed state as depicted while viewing the present invention from the outside and attached to a typical explosion containment and suppression chamber.
Figure 2:
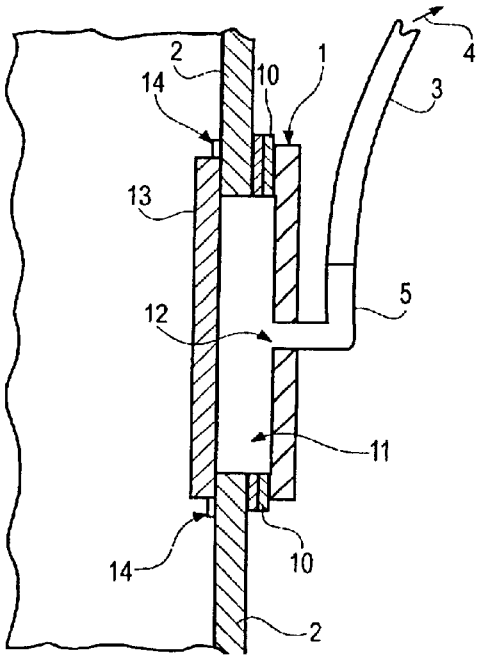
FIG. 2 is a detailed cross-sectional view taken along cut line A—A of FIG. 1.
Figure 3:
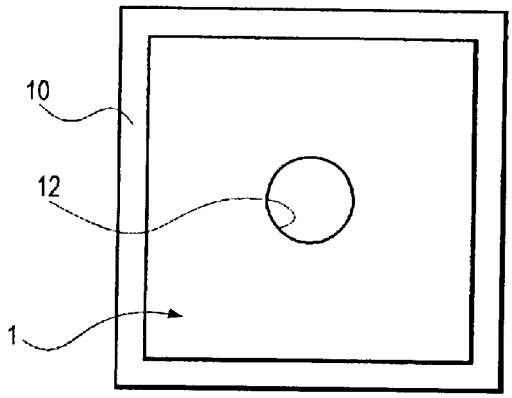
FIG. 3 is an elevation view of the inside plane of the present invention.

Referring to FIGS. 1, 2 and 3, the present invention airlock door 1 is preferably pivotally connected to the outside face of the explosion chamber 2 with an attaching means 6. The preferred attaching means is a pivotal mount, such as a hinge device, wherein the preferred embodiment is configured to close inwardly towards the explosion chamber 2. Alternately, other types of attaching means 6 can be utilized, such as a threaded bolting means, attaching clasps, or the like. The airlock door 1 is preferably constructed of a non-corrosive material such as hardened steel, fiberglass, plastics, composite resins or the like.

In the preferred embodiment of the present invention, the airlock door 1, when in a closed and sealed position, is seated into a door seal seat 9, which is preferably an integrated component of the explosion suppression chamber 2 outer wall. Alternately, the airlock door 1 can seat flush against the exterior surface of the explosion suppression chamber 2. The preferred embodiment further contains a sealing membrane 10 placed along the intersection between the airlock door 1 and the door seal seat 9. The sealing membrane 10 is preferably attached to the interior periphery of the airlock door 1. Alternately, the sealing membrane 10 can be attached to the periphery of the explosion chamber access location. Still alternately, the sealing membrane 10 can be manually placed prior to closing the airlock door 1. The sealing membrane 10 is preferably constructed of a flexible, resilient material that is nonreactive to toxins and chemicals typically found in military weaponry.

Furthermore, the preferred embodiment has at least one handle 7 to aid in opening the airlock door 1. Alternately, the airlock door 1 can be mechanically or hydraulically operated to facilitate opening and closing.

The preferred embodiment also has a locking means 8 to ensure that an airtight seal between the airlock door 1 and the door seal seat 9 is established and maintained once the airlock door 1 is in a closed position and is locked with the locking means 8.

The locking means is preferably hand-tightened threaded bolts with a handle extension. As such, when the airlock door 1 is in a closed position, the present invention creates an airtight cavity 11 between the inner surface of the airlock door 1 and the outer surface of the explosion suppression chamber primary door 13. The cavity 11 is an airtight containment, thus ensuring that there is no toxic leakage to the environment should the primary explosion suppression chamber access door's seal fail.

The preferred embodiment of the present invention also utilizes at least one preferably flexible hose 3 connected at its proximate end to an orifice with a hose connecting means 5, preferably located at the approximate center of the airlock door 1, thus providing access to the cavity 11. Alternately, the flexible hose 3 can be connected in other locations within the airlock door 1. Further alternately, the present invention can be utilized without the flexible hose 3 and hose connecting means 5.

The distal end of the flexible hose 3 is connected to an air pressure adjusting means, which is preferably an air handling or cleaning system (not shown). As such, the air handling or cleaning system provides the requisite vacuum force 4 need to provide negative, vacuum pressure, to evacuate substantially all of the air contained within the cavity 11 when the air handling system is activated.

An alternate embodiment of the present invention uses at least one one-way filter membrane or a one-way check valve placed within the airlock door 1. The one-way filter membrane or check valve can be configured in such a way as to allow air to flow into the cavity while preventing air from the cavity to exit the air lock. As such, while applying negative, vacuum pressure to the airlock cavity, the filter member or check valve will allow a continuous flow of fresh air to enter the airlock cavity, thus providing enhanced air flow and air replacement within the airlock cavity.

Yet another alternate embodiment of the present invention uses at least one filter membrane placed within the airlock door 1. The filter membrane trapping size utilized is contingent upon the type of expected toxins destroyed within the explosion suppression chamber. For example, if a viral containing biological weapon is destroyed, a filter membrane trapping size suitable to filter particulate up to 1 micron in size can be utilized. As such, to clean potentially toxic air within the cavity 11, the air pressure adjusting means can be an air compressor device thus delivering positive pressurization to cavity 11, subsequently forcing the contained air within the cavity 11 through the filter membranes. Still alternately, different air delivery hoses and means can be utilized apart from the flexible hose 3.

While preferred and alternate embodiments have been described herein, it is to be understood that these descriptions are only illustrative and are thus exemplifications of the present invention and shall not be construed as limiting. It is to be expected that others will contemplate differences, which, while different from the foregoing description, do not depart from the true spirit and scope of the present invention herein described and claimed.

What is claimed is:

1. A method of hermetically sealing openings of an explosion suppression chamber, said explosion suppression chamber having at least one opening susceptible to environmental leakage and an outside surface, said opening closed with a closing means, said method comprising the steps of:

attaching a door to said explosion suppression chamber with an attaching means; and creating an airlock with a means of providing an airlock between said door and said closing means of said opening when said door is in a closed position by providing a cavity between said closing means of said opening and said door when said door and said closing means are both in a closed position, placing a sealing means between the intersection of said door and said outside surface of said explosion suppression chamber whereby when said door is closed an airtight seal is created between the intersection of said sealing means and said outside surface of said explosion suppression chamber, and adjusting air pressure within said cavity with a means of adjusting pressure that comprises at least one orifice located within said door and at least one hose, said hose having a distal end and a proximate end, said proximate end of said hose attached to said orifice with a connecting means, said distal end of said hose attached to an air pressure adjusting device.

2. The method of claim 1, wherein said attaching means comprises a pivot means.

3. The method of claim 2, wherein said pivot means comprises a hinge device.

4. The method of claim 2, wherein said door is inwardly closable towards said explosion suppression chamber.

5. The method of claim 1, wherein said door is constructed of a non-reactive material.

6. The method of claim 1, wherein said sealing means comprises a sealing membrane.

7. The method of claim 6, wherein said sealing membrane is constructed of a resilient material.

8. The method of claim 1, further comprising the step of placing a check-valve within said door.

9. The method of claim 1, wherein said air pressure adjusting device comprises an air handling and cleansing system thereby providing vacuum pressure to said cavity when said air handling and cleansing system is operational.

10. The method of claim 1, further comprising the step of placing at least one filter membrane material within said door.

11. The method of claim 10, wherein said air pressure adjusting device comprises an air compressing device which supplies positive air pressure into said cavity, thereby forcing substantially all of the air encapsulated within said cavity through said filter membrane and trapping any entrained toxins.

12. An airlock apparatus to hermetically seal openings within an explosion suppression chamber, said explosion suppression chamber having at least one opening susceptible to environmental leakage and an outside surface, said opening closed with a closing means, said apparatus comprising:

at least one door, said door attached to said explosion suppression chamber with an attaching means; and a means of providing an airlock between said door and said closing means of said opening when said door is in a closed position, said means of providing an airlock comprising:

a cavity between said closing means of said opening and said door when said door and said closing means are both in a closed position;

a sealing means placed between the intersection of said door and said outside surface of said explosion suppression chamber whereby when said door is closed an airtight seal is created between the intersection of said door and said outside surface of said explosion suppression chamber; and a means of adjusting air pressure within said cavity comprising at least one orifice located within said door and at least one hose, said hose having a distal end and a proximate end, said proximate end of said hose is connected to said orifice with a connecting means, said distal end of said hose attached to an air pressure adjusting device.

13. The apparatus of claim 12, wherein said attaching means comprises a pivot means.

14. The apparatus of claim 13, wherein said pivot means comprises a hinge device.

15. The apparatus of claim 13, wherein said door is inwardly closable towards said explosion suppression chamber.

16. The apparatus of claim 12, wherein said door is constructed of a non-reactive material.

17. The apparatus of claim 12, wherein said sealing means comprises a sealing membrane.

18. The apparatus of claim 17, wherein said sealing membrane is constructed of a resilient material.

19. The apparatus of claim 17, wherein said air pressure adjusting device comprises an air handling and cleansing system thereby providing vacuum pressure to said cavity when said air handling and cleansing system is operational.

20. The apparatus of claim 12, further comprising at least one check value placed within said door.

21. The apparatus of claim 12, further comprising at least one filter membrane placed within said door.

22. The apparatus of claim 21, wherein said airlock air pressure adjusting device comprises an air compressing device which supplies positive air pressure into said cavity, thereby forcing air encapsulated within said cavity through said filter membrane and trapping any entrained toxins.

23. The apparatus of claim 12, wherein said door further comprises at least one handle.

24. The apparatus of claim 12, wherein said door further comprises a locking means which is activated when said door is in a closed position.

* * * * *